US006773238B1

(12) United States Patent
Sprakel

(10) Patent No.: US 6,773,238 B1
(45) Date of Patent: Aug. 10, 2004

(54) PUMPING DEVICE FOR DISCHARGING LARGE AMOUNTS OF LIQUID

(75) Inventor: Jan Sprakel, Wermelskirchen (DE)

(73) Assignee: KAMAT-Pumpen GmbH & Co. KG, Witten-Annen (DE)

( * ) Notice: Subject to any disclaimer, the term of this patent is extended or adjusted under 35 U.S.C. 154(b) by 0 days.

(21) Appl. No.: 10/030,668

(22) PCT Filed: Jul. 12, 2000

(86) PCT No.: PCT/EP00/06633

§ 371 (c)(1),
(2), (4) Date: May 15, 2002

(87) PCT Pub. No.: WO01/04494

PCT Pub. Date: Jan. 18, 2001

(30) Foreign Application Priority Data

Jul. 12, 1999 (DE) ..... 199 32 078

(51) Int. Cl.[7] ..... F04B 53/00; F04B 23/04
(52) U.S. Cl. ..... 417/234; 417/521; 417/539
(58) Field of Search ..... 417/234, 364, 417/521, 539

(56) References Cited

U.S. PATENT DOCUMENTS 2,074,702 A 3/1937 MacClatchie
3,249,062 A 5/1966 Corberly et al.
3,780,912 A 12/1973 Sanz
4,050,862 A * 9/1977 Buse ..... 417/539
4,687,426 A * 8/1987 Yoshimura ..... 417/539
5,158,153 A * 10/1992 Snow et al. ..... 184/27.2
5,480,288 A 1/1996 Hellenberg et al.
5,839,888 A * 11/1998 Harrison ..... 417/521

FOREIGN PATENT DOCUMENTS

FR 2 482 206 11/1981
GB 24 047 10/1909
GB 2 101 231 A 1/1983

* cited by examiner

*Primary Examiner*—Charles G. Freay
(74) *Attorney, Agent, or Firm*—Proskauer Rose LLP

(57) ABSTRACT

This invention relates to a device for pumping high delivery volumes of a liquid, with at least two pumps each forming a single structural unit, which are jointly hooked up to a pressure line on the delivery side, and coupled to a single drive. The device according to the invention further develops the known device described in greater detail above in such a way as to provide an easily transported and space-saving device. This is achieved by virtue of the fact that at least one pump (4) is positioned in a plane spaced vertically apart from the plane in which the respective other pump (5, 6) is located.

5 Claims, 4 Drawing Sheets

PUMPING DEVICE FOR DISCHARGING LARGE AMOUNTS OF LIQUID

BACKGROUND OF THE INVENTION

The invention relates to a device for pumping high delivery volumes of a liquid, with at least two pumps each forming a single structural unit, which are on the delivery side jointly hooked up to a pressure line, and coupled to a single drive.

Such pumps are used when testing and cleaning pipelines. To test pipelines, they are checked for tightness by "stressing". In this case, a liquid, e.g., water, is pumped into the pipelines under a pressure exceeding that of the medium to be conveyed in the pipeline during operation. If the pipeline inspected in this way stays tight under a higher test pressure, it is assumed that it will also remain so during operation at a pressure lower than the test pressure.

The length of the section that can be checked during the process of stressing depends on the amount of liquid that can be introduced into the pipeline. The higher the quantity of liquid that can be pumped into the pipeline at the desired pressure, the greater the length of the section that can be checked. The greater the length of the individual sections, the lower the number of stressing processes required for checking a given pipeline section, and the lower the costs associated with inspecting this pipeline section.

Known from practice is a device in which several pumps that respectively form a structural unit are jointly hooked up to a pressure line on the delivery side. This enables a high overall delivery volume for the device in the sum of individual delivery volumes for the individual pumps.

In the known device, high-pressure pumps with as high an odd number of cylinders are used. This makes it possible to minimize the pulsation of conveyed liquid by adjusting the pump stroke of the individual cylinders to each other in such a way that the pulsations resulting from the individual pump strokes mutually reduce or cancel each other out.

As a whole, the known device consists of three modules, a drive unit, a first pump unit and a second pump unit. The individual pumps of the known device are driven by the shared drive. A power divider coupled to the drive shafts of the pumps is connected to the drive. In this case, two pumps are arranged on a shared drive shaft in the first pump unit, while only one pump is provided in the second pump unit.

It has been shown in practice that this device is inconvenient due to the high number of modules and associated space requirement. Pipelines are respectively stressed on site at the individual segments of the pipelines. To this end, the device must be transported to the individual sections of the pipeline. In the known device, this is done by dismantling the device into its individual modules and transporting it module by module to the site.

SUMMARY OF THE INVENTION

The object of the invention is to further develop the known device described in greater detail above in such a way as to provide an easily transported and space-saving device.

This object is achieved in a device of the kind indicated at the outset by positioning at least one of the pumps in a plane spaced vertically apart from the plane in which the respective other pump is located. The vertically spacing makes it possible to stack the individual pumps one atop the other, significantly economizing on space. In addition, the invention makes it possible to combine the individual aggregates of the device into modules. These can simply be transported to the respective site and there be set up in a space-saving manner.

The driving power of the shared drive is preferably distributed to the drive shafts of the individual pumps by a power divider. In this case, it is best if each plane has allocated to it a power divider via which the pumps assigned to this plane are coupled with each other on the drive side, and the power dividers are additionally coupled together, so that the pumps can be connected to the shared drive by one of the power dividers.

In a special embodiment of the invention, the planes can run parallel to each other, and the power divider allocated to one plane can be coupled with the power divider of the other plane by a shaft running perpendicular to the respective plane.

One preferred embodiment of the invention exhibits three pumps, of which two are situated in one plane, and the third is positioned in the plane situated at a vertical distance thereto.

The device is especially easy to transport if their individual parts are accommodated in a casing, whose size corresponds to the dimensions of a standard container, e.g., an ISO 20" container.

A device of the kind described in the invention optimized to minimize pulsation as much as possible is characterized by the fact that the pumps are coupled with the drive in such a way that each of them executes a pump stroke relative to the respective other pumps shifted by a specific, fixed time interval. In this embodiment, the pump strokes of the individual pumps are harmonized in such a way as to largely avoid a pulsation in the pressure line. Devices according to the invention set up in this way require no more pulsation dampers, and are particularly suitable as devices for stressing pipelines due to the achieved lack of pulsation, and because they are easy to dismantle and transport given the structural distribution of the device according to the invention over several vertical planes. This embodiment of the invention can here be realized in a simple manner by coupling the pumps with the drive by means of a crankshaft, wherein the stroke journals are uniformly distributed around the rotational axis of the crankshaft.

BRIEF DESCRIPTION OF THE DRAWINGS

The invention will be explained in greater detail below based on a drawing that shows only a single embodiment. The drawing shows.

DETAILED DESCRIPTION OF THE INVENTION

Figure 1:
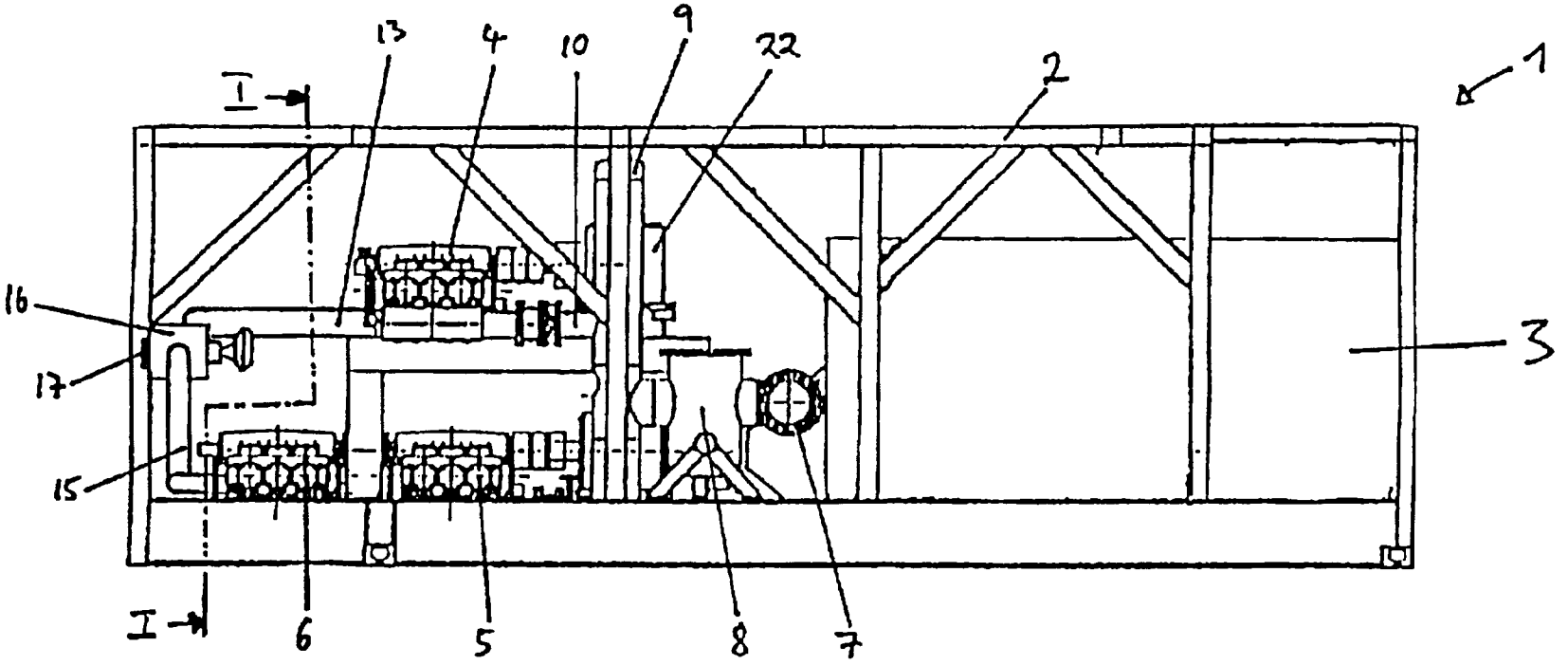
FIG. 1 a side view of the device according to the invention.
Figure 2:
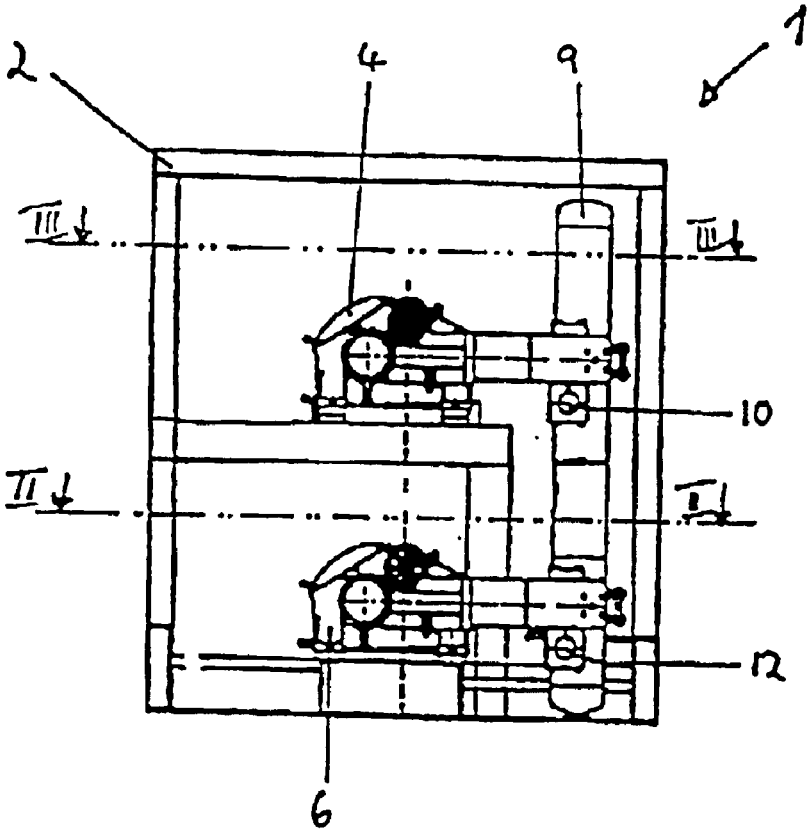
FIG. 2 a sectional view according to the I—I line on FIG. 1.
Figure 3:
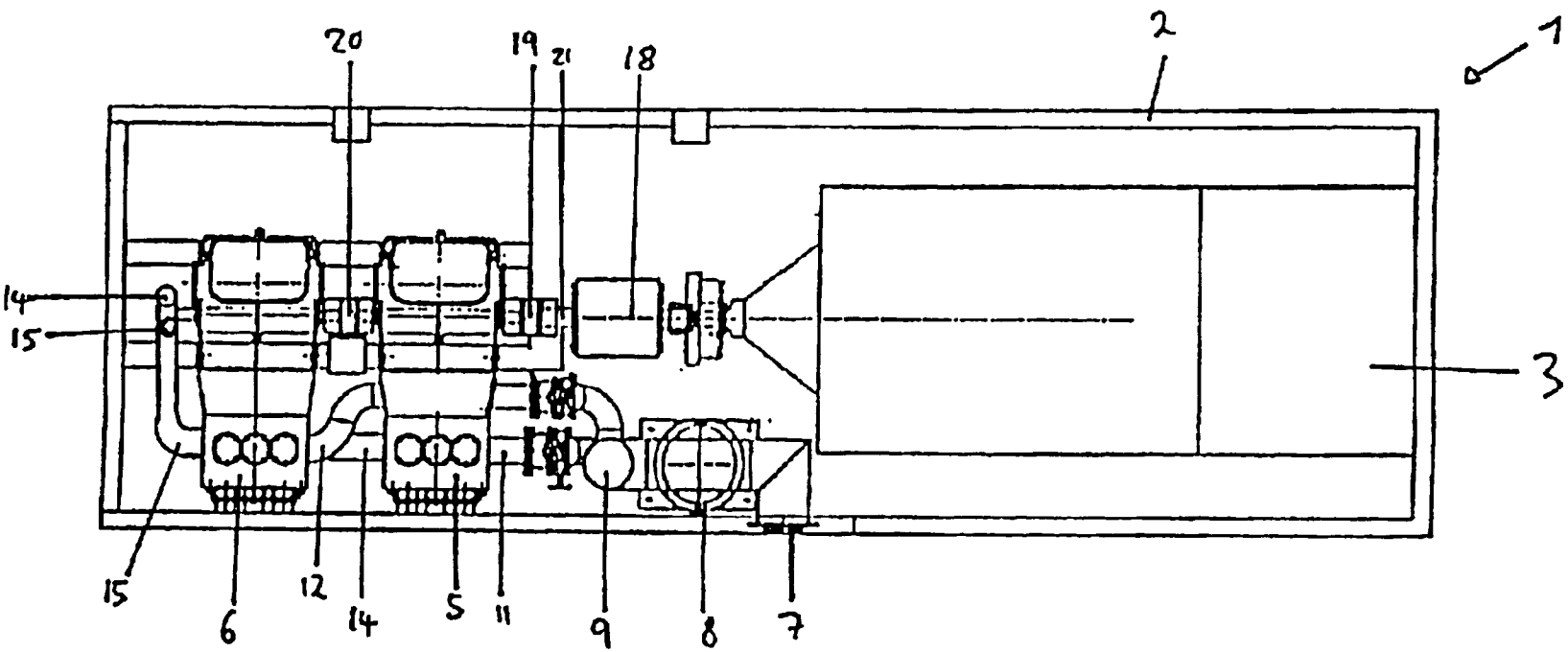
FIG. 3 a sectional view according to the II—II line on FIG. 2.
Figure 4:
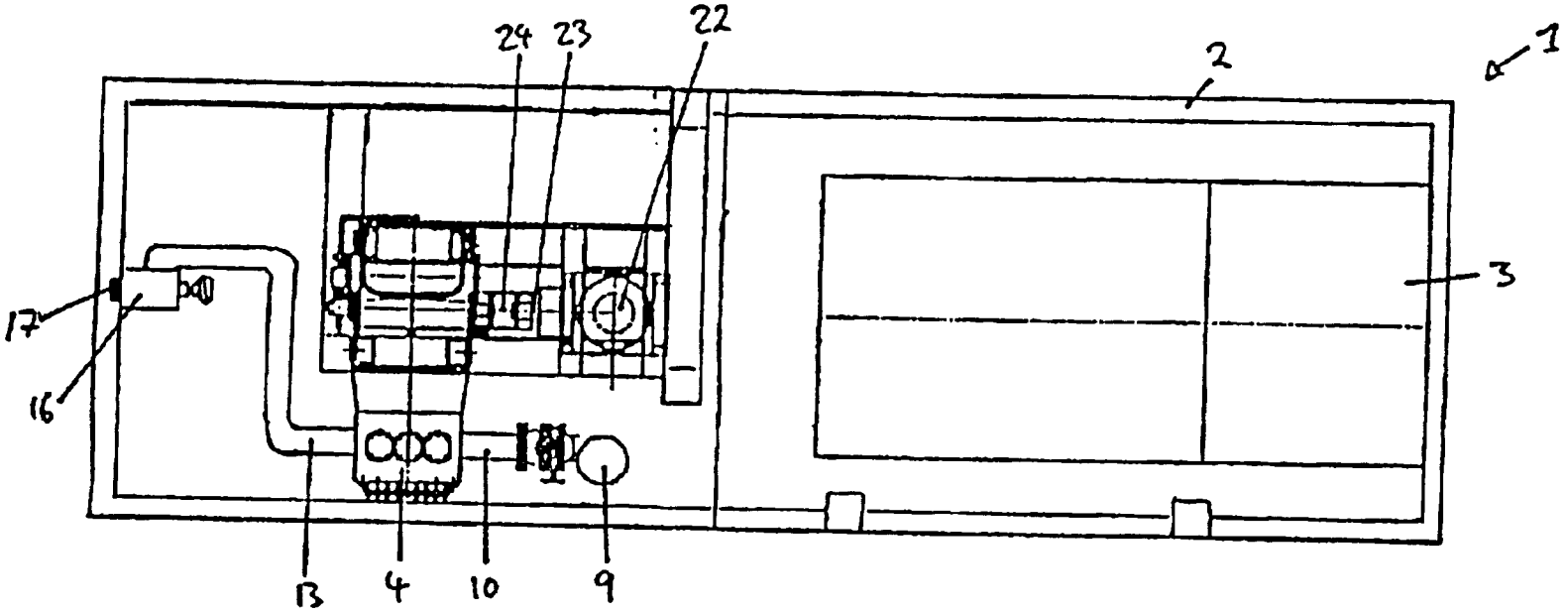
FIG. 4 a sectional view according to the III—III line on FIG. 2.

FIG. 1 shows a side view of the device according to the invention that forms a single module 1. The module is formed by a frame 2, whose dimensions correspond to those of a standard container. The drive unit 3 and pumps 4, 5, 6 are situated in the frame 2. In this case, the pump 4 is placed on a plane above the pumps 5, 6.

Provided as the inlet for the liquid to be conveyed is an inflow nozzle 7 leading to a filter 8, to which a distribution cylinder 9 is connected. Suction lines 10, 11, 12 lead from this distribution cylinder 9 to the pumps 4, 5, 6.

Situated on the delivery side of the pumps 4, 5, 6 are pressure lines 13, 14, 15, which are routed together in a pressure control valve 16. An outflow nozzle 17 is provided on the pressure control valve 16.

The pumps 4, 5, 6 are driven by the drive unit 3. The drive unit 3 can be an internal combustion engine, and has connected to it a power divider 18 in the plane of the pumps 5, 6. A drive shaft 21 that is provided with couplings 19, 20 and accommodates pumps 5, 6 leads away from the power divider. A second power divider 22 is connected via a perpendicular shaft to the power divider 18, which lies in the same horizontal plane as the pump 4. A coupling 24 connects the pump 4 to this power divider 22 via a drive shaft 23.

The shown device according to the invention is operated as follows:

The drive 3 outputs its drive power to the power divider 18, from which the line is relayed to the drive shaft 21 and the second power divider 22. The drive shaft 21 drives the pumps 5, 6, while the pump 4 is driven by the drive shaft 23 extending from the power divider 22.

The pumps 4, 5, 6 driven in this way draw liquid from the distribution cylinder 9 through their suction lines 10, 11, 12. This distribution cylinder 9 is fed by liquid that passes through the inflow nozzle 7 and the filters 8 connected thereto. The liquid is pumped into the pressure lines 13, 14, 15 by the pumps 4, 5, 6. These empty out in the pressure control valve 16, which controls the pressure of the liquid discharged from the device. Lines (not shown) that route the conveyed liquid into the pipelines to be inspected are connected to the outflow nozzles 17.

The described device provides a compact device for pumping high delivery volumes of a liquid, which can be readily transported due to its slight dimensions.

What is claimed is:

1. A device for pumping high delivery volumes of a liquid, said device comprising at least two pumps respectively forming a single structural unit, said at least two pumps on a delivery side being jointly hooked up to a pressure line, and coupled to a single drive, wherein at least one of the at least two pumps is positioned in a plane spaced vertically apart from the plane in which the respective other pumps are located, and wherein each plane has allocated to it a power divider via which the pumps assigned to this plane are coupled with each other on the drive side, and wherein the at least two pumps are coupled with the drive in such a way that each of them executes a pump stroke relative to the respective other pumps shifted by a specific, fixed time interval.

2. A device according to claim 1, wherein the power dividers are additionally coupled together, and wherein the pumps are connectable to the shared drive by one of the power dividers.

3. A device according to claim 1, wherein the planes run parallel, and wherein a power divider allocated to one plane is coupled with a power divider of the other shaft by a shaft running perpendicular to the respective plane.

4. A device according to claim 1, further comprising three pumps wherein two of said three pumps are arranged in one plane, and a third of said three pumps is positioned in the plane spaced vertically apart thereto.

5. A device according to claim 1, wherein individual parts of said device are accommodated in a casing whose dimensions correspond to those of a standard container.

* * * * *